United States Patent [19]

Case et al.

[11] Patent Number: 4,826,455

[45] Date of Patent: May 2, 1989

[54] TERMINAL CONTACT ASSEMBLY

[75] Inventors: Arnold A. Case, West Chicago; Frederick L. Lau, Skokie; Emma Basov, Buffalo Grove, all of Ill.

[73] Assignee: Switchcraft, Inc., Chicago, Ill.

[21] Appl. No.: 208,717

[22] Filed: Jun. 20, 1988

[51] Int. Cl.[4] ..... H01R 13/428

[52] U.S. Cl. ..... 439/744; 439/751; 439/555

[58] Field of Search ..... 439/595, 597, 600–603, 439/744, 750, 549, 552, 555, 557, 567, 751

[56] References Cited

U.S. PATENT DOCUMENTS

| | | | |
|---|---|---|---|
| 2,995,617 | 8/1961 | Maximoff et al. | 174/153 |
| 3,205,297 | 9/1965 | Brock | 174/68.5 |
| 3,279,040 | 10/1966 | Propster, Jr. | 29/155.5 |
| 3,365,539 | 1/1968 | Bratsch | 174/88 |
| 3,582,863 | 6/1971 | Hoffman | 439/597 |
| 4,220,384 | 9/1980 | Clark et al. | 439/595 |
| 4,364,621 | 12/1982 | Janvrin et al. | 439/595 |
| 4,541,036 | 9/1985 | Landries et al. | 439/557 |
| 4,707,045 | 11/1987 | Ney et al. | 439/588 |

FOREIGN PATENT DOCUMENTS

| | | | |
|---|---|---|---|
| 2822097 | 12/1979 | Fed. Rep. of Germany | 439/595 |
| 0089742 | 6/1967 | France | 439/595 |

*Primary Examiner*—David Pirlot

*Attorney, Agent, or Firm*—William R. Clark; John T. Meaney; Richard M. Sharkansky

[57] ABSTRACT

A terminal contact assembly comprising a dielectric sleeve of flexible material having a midportion provided with a transverse integral partition wherein a keyway slot extends from an open end thereof communicating with a longitudinal slot in a defining wall portion of the sleeve, through a restricted portion of the keyway slot, to a larger closed end portion thereof centrally disposed in the partition. This assembly also comprises an elongated rigid contact of electrically conductive material having a midportion with an hour glass configuration including a narrow neck portion or key which is inserted laterally through the longitudinal slot in the sleeve and enters the open end of the keyway slot. The key is pressingly urged through the restricted portion of the keyway slot, by virtue of adjacent portions of the sleeve and the integral partition flexing momentarily to widen the restricted portion, and snaps into the larger closed end of the keyway slot thereby locking the contact axially within the sleeve. The dielectric sleeve supporting the contact is press-fitted longitudinally through a suitably configured and sized hole in a rigid mounting plate to have the defining wall portions of the sleeve held tightly about the axially disposed contact.

9 Claims, 4 Drawing Sheets

TERMINAL CONTACT ASSEMBLY

BACKGROUND OF THE INVENTION

1. Field of the Invention

This invention relates generally to electrical connecting devices and is concerned more particularly with an elongated electrical contact disposed longitudinally in a dielectric sleeve for mounting in a support panel.

2. Discussion of the Prior Art

There has been developed in the prior art a terminal contact assembly comprising an elongated electrical contact disposed axially in a dielectric bushing for mounting the contact insulatingly in a metal support plate or panel. Generally, the terminal contact is inserted axially into an end of the dielectric bushing and is urged inwardly of the bushing until lockingly engaged therein. Also, the bushing with the contact therein generally is inserted forcefully into a suitably configured and sized hole extended through the thickness of the panel thereby securely engaging the panel. Thus, the terminal contact and the dielectric bushing are enabled to resist axial and lateral forces exerted on the contact when connecting it to an electrical conductor or another electrical connecting device.

When inserting the terminal contact in the dielectric bushing, it usually is necessary to align the contact with an open end of the bushing and to urge the contact axially into the bushing with sufficient force to secure the contact lockingly in the bushing without damaging the dielectric bushing. Also, when installing the bushing with the contact therein in the hole in the support panel, it usually is necessary to press the bushing axially into the hole with sufficient force for causing the bushing to engage the panel securely without damaging the bushing. Consequently, special tools or machines may be required for inserting the terminal contact in the dielectric bushing and for installing the bushing with the contact therein in the metal support panel. However, the special tools or machines may not be readily available in the field when the replacement of one or more terminal contact assemblies may be required.

SUMMARY OF THE INVENTION

Accordingly, these and other disadvantages of the prior art are overcome by this invention providing a terminal contact assembly including an elongated terminal contact and an outer dielectric sleeve which may be assembled and installed in a hole in a support plate or panel without the need of special tools or equipment.

The terminal contact of this invention comprises a longitudinally rigid body of electrically conductive material with opposing end portions integrally joined to one another through a blade-like midportion having an hour glass configuration and a predetermined thickness. Extending transversely into the blade-like midportion from opposing sides thereof are respective aligned notches having generally U-shaped configurations and substantially uniform widths. The notches have respective closed ends separated from one another by an interposed key comprising a narrow neck portion of the contact which extends longitudinally thereof and has a predetermined length. The key has opposing ends integrally joined to respective wider portions of the contact which define opposing sides of the transversely extending notches. Thus, the predetermined length of the key generally corresponds to the respective uniform widths of the notches. The opposing end portions of the contact may be designed for electrically connecting to male or female types of electrical contact terminations or may be designed for terminating electrical conductors by conventional means, as by wire-wrapping or insulation displacement techniques, for examples.

The dielectric sleeve of this invention comprises an elongated tubular wall of dielectric material having extended through its thickness a longitudinal slot which extends from one end to the opposing end of the sleeve. Opposing end portions of the sleeve are integrally joined to one another through a midportion of the sleeve having transversely disposed therein an integral partition provided with a predetermined thickness. Extended through the thickness of the partition is a keyway slot having an open end disposed in communication with an aligned portion of the longitudinal slot in the defining wall of the sleeve. The keyway slot extends from it open end through a restricted or reduced width portion of the keyway slot to a relatively larger, closed end portion thereof which is centrally disposed with respect to the sleeve. One end portion of the sleeve is slotted longitudinally to provide on either side of the longitudinal slot respective integral posts which flex laterally. The lateral flexibility of the posts in conjunction with the lateral flexibility of portions of the partition adjacent either side of the open end portion of the slot permit the restricted portion of the keyway slot to be forced open slightly.

In assembly, the blade-like midportion of the terminal contact is inserted laterally into the longitudinal slot in the defining wall of the dielectric sleeve, such that the key or narrow neck portion of the contact enters the open end portion of the keyway slot in the partition. The blade-like midportion of the contact is pressed laterally into the sleeve whereby the key is forced through the restricted portion of the keyway slot by virtue of the partition material adjacent the open end portion of the keyway slot and the adjacent posts flexing laterally. As a result, the key snaps into the relatively larger, closed end portion of the keyway slot and the restricted portion thereof is permitted to return to its reduced width thereby locking the key portion of the contact in the closed end portion of the keyway slot which is centrally disposed within the sleeve.

Thus, it may be seen that the partition is provided with a predetermined thickness and the key is provided with a predetermined length so that the key will extend completely through the thickness of the partition. As a result, the relatively wider portions of the contact, which are joined integrally to respective ends of the key, are disposed adjacent respective opposing surfaces of the partition and bear against one of the surfaces when an axially directed insertion or withdrawal force is exerted on the contact. Accordingly, the opposing surfaces of the partition function as respective positive stops in restricting axial movement of the contact relative to the sleeve.

BRIEF DESCRIPTION OF THE DRAWINGS

For a better understanding of the disclosed invention, reference is made in the following detailed description to the drawings wherein.

DESCRIPTION OF THE PREFERRED EMBODIMENT

Figure 1:
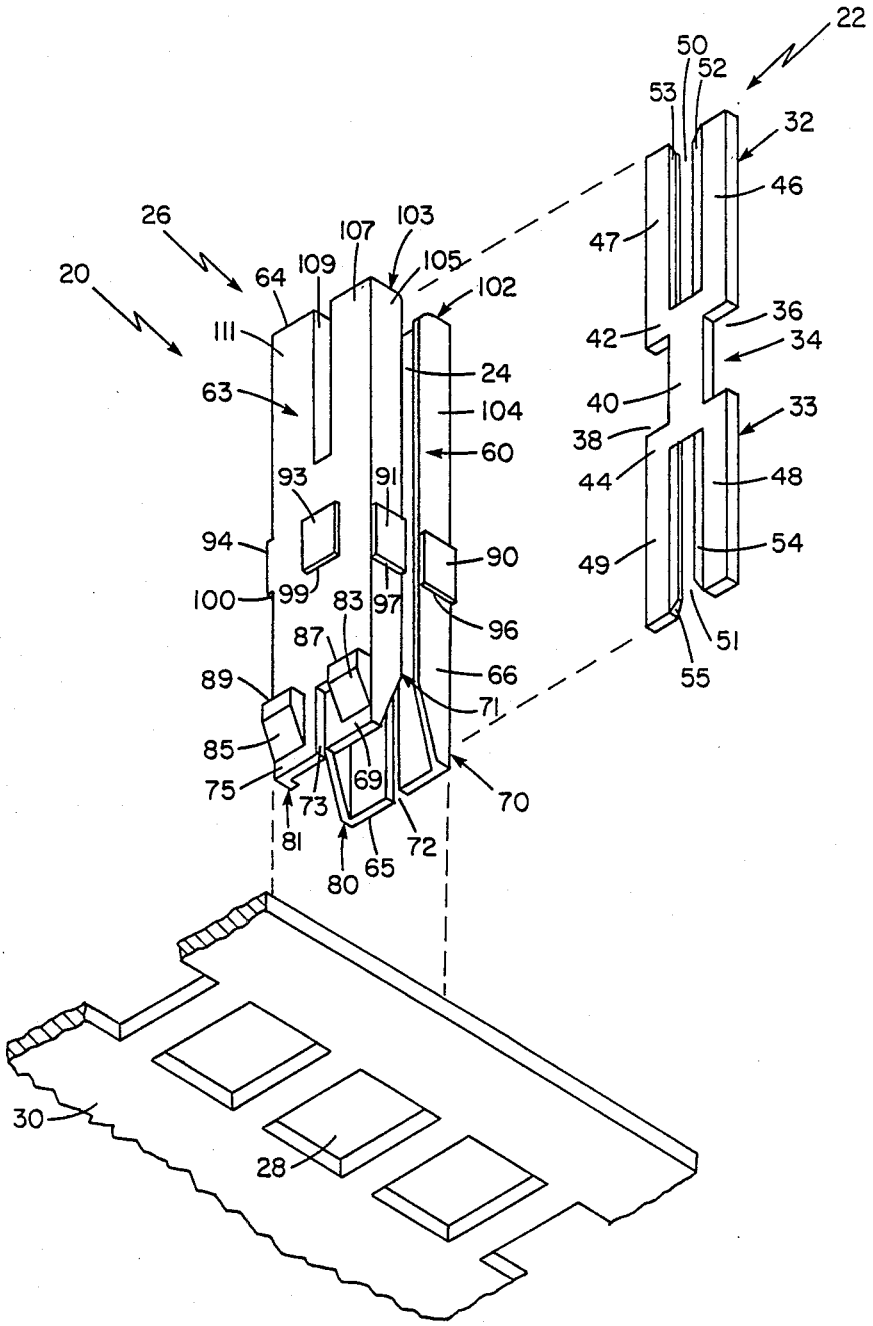
FIG. 1 is an isometric exploded view of a terminal contact assembly embodying the invention.

Referring to the drawings wherein like characters of reference designate like parts throughout the several views, FIG. 1 shows a terminal contact assembly 20 comprising a blade-like contact 22 having a suitable thickness for lateral insertion into a longitudinal slot 24 in a defining wall portion of a dielectric bushing or sleeve 26 and for locking engagement within the sleeve. The contact 22 then may be mounted insulatingly by means of the outer dielectric sleeve 26 in a suitably configured and sized hole 28 in a support plate or panel 30 made of electrically conductive material, such as aluminum, for example. Alternatively, the hole 28 may be provided in a support plate or panel 30 made of suitably rigid dielectric material, such as a fiberglass epoxy resin material generally used in the fabrication of printed circuit boards, for example.

Contact 22 comprises an elongated body of electrically conductive material, such as a nickel silver material, for example, having sufficient thickness for providing the body with longitudinal rigidity. The contact 22 has opposing bifurcated end portions, 32 and 33, respectively, which are integrally joined to one another through an interposed midportion 34 having an hourglass configuration. Extending transversely into the midportion 34 from opposing longitudinal sides of the contact 22 are mutually aligned notches, 36 and 38, respectively, having generally U-shaped configurations and having substantially equal width dimensions measured longitudinally of the contact. The closed ends of the notches 36 and 38 are separated from one another by an interposed key 40 comprising a narrow neck portion of contact 22. Key 40 has opposing ends integrally joined to relatively wider portions, 42 and 44, respectively, of the contact 22 defining respective opposing sides of the notches 36 and 38. Thus, the length of the key 40 corresponds substantially to the uniform widths of the notches 36 and 38, respectively, and the relatively wider portions 42 and 44 of contact 22 provide respective laterally extending pairs of coplanar shoulders at opposing ends of the key 40.

Each of the wider portions 42 and 44 may be yoke-like and have projecting longitudinally from opposing end portions thereof a coplanar pair of integral legs or tines 46, 47 and 48, 49, respectively. The tines 46, 47 are separated laterally by an interposed open-ended slot 50 of predetermined width; and the tines 48, 49 are separated laterally by an interposed open-ended slot 51 of predetermined width which may be substantially equal or different from the predetermined width of slot 50. Tines 46 and 47 have adjacent slot 50 respective longitudinal side portions which are tapered convergently toward the slot 50 to provide on opposing sides thereof respective edge-like edges 52 and 53. Similarly, the tines 48 and 49 have adjacent slot 51 respective longitudinal side portions which are tapered convergently toward the slot 51 to provide on opposing sides thereof respective wedge-like edges 54 and 55.

Thus, the terminal contact 22 may be electrically connected to an insulation coated wire conductor (not shown) by well-known insulation displacement techniques. For example, the insulation coated wire conductor may be disposed transversely to the open end of slot 51 and inserted forcefully therein whereby the wedge-like edges 54 and 55 press through the insulation coating and electrically contact the wire conductor. Also, the terminal contact 22 may be electrically connected to a blade-like male contact of a connecting device (not shown). For example, a male contact protruding from an electronic module may be pressed longitudinally into the open end of slot 50 whereby the wedge-like edges 52 and 53, respectively, electrically contact respective opposing flat surfaces of the blade-like male contact. Alternatively, the wider portions 42 and 44 may not be yoke-like but taper laterally inward of contact 22 to join respective integral shaft-like end portions (not shown) suitable for terminating respective wire conductors by well known wire-wrapping techniques. Accordingly, the novelty of the described terminal contact does not lie in the configuration of the end portions but in the midportion having an hour-glass configuration and a suitable thickness for inserting laterally into the longitudinal slot 24 in the defining wall portion of dielectric sleeve 26.

Figure 5:
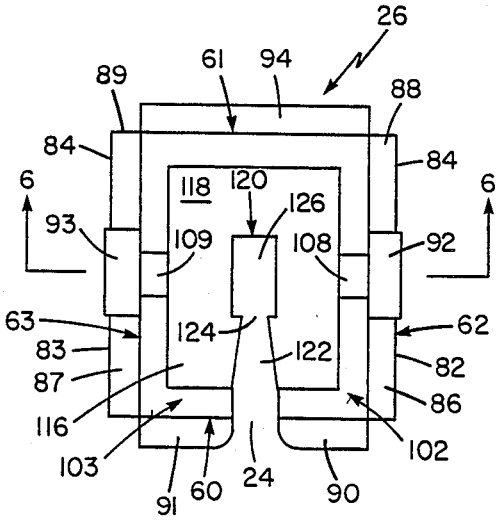
FIG. 5 is an enlarged plan view of the dielectric sleeve taken along the line 5—5 shown in FIG. 2 and looking in the direction of the arrows.
Figure 6:
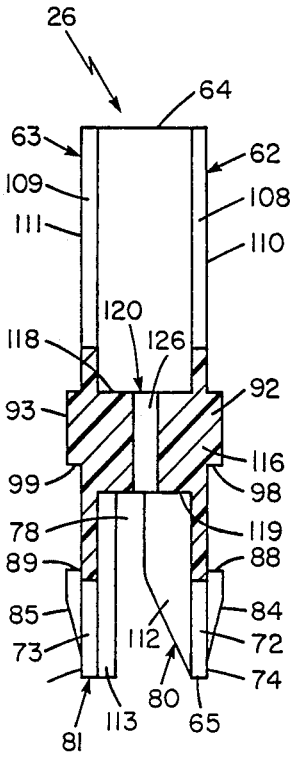
FIG. 6 is a longitudinal sectional view of the dielectric sleeve taken along the line 6—6 shown in FIG. 5 and looking in the direction of the arrows.

The dielectric sleeve 26 is made of a moldable plastic material having flexibility in the cured state, such as the class of synthetic long chain polymeric amides with recurring amide groups, for example. Dielectric sleeve 26 has defining wall portions joined integrally to one another to provide the sleeve 26 with a hollow rectangular cross-sectional configuration, as shown in FIGS. 5 and 6. Alternatively, the dielectric sleeve 26 may have defining wall portions joined integrally to one another to provide the sleeve with any other suitable cross-sectional configuration, such as toroidal, for example. In that event, the sleeve-receiving hole 28 in support panel 30 may be supplied with another conforming configuration, such as circular, for example, and with a suitable size for providing a periphery which snugly encircles the sleeve 26.

Figure 2:
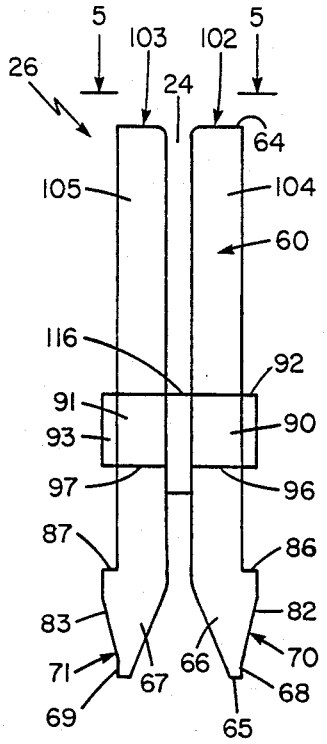
FIG. 2 is an elevational view of a fully slotted, open side wall of the dielectric sleeve shown in FIG. 1.

As shown in FIG. 2, the integral defining wall portions of sleeve 26 include a fully slotted or open side wall 60 having extended through its thickness the contact-receiving slot 24. Slot 24 extends longitudinally from a distal end 64 of sleeve 26, which terminates a projecting end portion thereof, to a proximal end 65 of sleeve 26 which terminates a support-engaging end portion of the sleeve. In the support-engaging end portion of sleeve 26, the adjacent end portion of slot 24 has an inverted funnel-like configuration and is disposed between wedge-shaped wall portions 66 and 67 of right-angled flexible legs, 70 and 71, respectively. The funnel-like configuration of the adjacent end portion of slot 24 permits the flexible legs 70 and 71 to flex inwardly toward one another in order to enable the support-engaging end portion of sleeve 26 to pass through the hole 28 in support panel 30 (FIG. 1).

Outer edge portions of the wedge-shaped wall portions 66 and 67 include side surfaces of integral ramp-like projections 82 and 83, respectively, which slope outwardly of sleeve 26 from adjacent the proximal end 65 thereof. The ramp-like projections 82 and 83 terminate in respective abrupt shoulders 86 and 87 which are substantially coplanar with one another. Spaced longitudinally from the plane of the shoulders 86 and 87 are respective block-like bosses 90 and 91 which protrude integrally outward from respective exterior surface portions of the side wall 60 on either side of the slot 24. The bosses 90 and 91 have adjacent the shoulders 86 and 87 respective sheer side surfaces 96 and 97 which are substantially coplanar with one another and spaced a predetermined linear distance from the plane of shoulders 86 and 87, respectively. Extending from the bosses 90 and 91 to the distal end 64 of sleeve 26 are respective interposed portions 104 and 105 of the side wall 60 constituting side wall components of right-angled flexible posts, 102 and 103, respectively, which are disposed on respective opposing sides of the slot 24.

Figure 3:
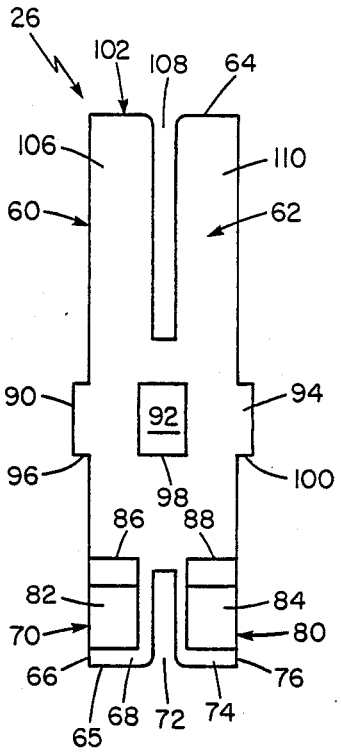
FIG. 3 is an elevational view of a side wall of the dielectric sleeve disposed orthogonally with respect to the fully slotted side wall shown in FIG. 2.

As shown in FIGS. 3, 5 and 6 the integral defining wall portions of sleeve 26 include partly slotted side walls, 62 and 63, respectively, which are similar to one another in appearance and structure. The side walls 62 and 63 are oriented orthogonally to the open side wall 60 and are disposed in spaced opposing relationship with one another. In the support-engaging end portion of sleeve 26, the side wall 62 has a corner portion 68 adjacent the open side wall 60 and a laterally aligned corner portion 74 which are separated from one another by an interposed slot 72 extended through the thickness of side wall 62. The corner portion 68 comprises the other side wall component of right-angled flexible leg 70 and has protruding integrally from its exterior surface the ramp-like projection 82 which slopes outwardly of sleeve 26 from adjacent the proximal end 65 thereof and terminates in shoulder 86. Corner portion 74 comprises a side wall component of a right-angled flexible leg 80 and has protruding integrally from its exterior surface a ramp-like projection 84 which is laterally aligned with the ramp-like projection 82. The ramp-like projection 84 slopes outwardly of sleeve 26 from adjacent the proximal end 65 thereof and terminates in an abrupt shoulder 88 which is substantially coplanar with the shoulder 86. Slot 72 has an open end disposed in the proximal end 65 of sleeve 26 and has an opposing closed end adjacent the shoulders 86 and 88 of ramp-like projections 71 and 73, respectively. Thus, the slot 72 by virtue of separating the flexible leg 70 from the flexible leg 80 enhances the flexibility of the respective legs 70 and 80.

Similarly, as shown in FIGS. 1, 5 and 6, the side wall 63 of sleeve 26 has a corner portion 69 adjacent the open side wall 60 and a laterally aligned corner portion 75 which are separated from one another by an interposed slot 73 extended through the thickness of side wall 63. The corner portion 69 comprises a side wall component o right-angled flexible leg 71 and has protruding integrally from its exterior surface the ramp-like projection 83 which slopes outwardly of sleeve 26 from adjacent the proximal end 65 thereof and terminates in shoulder 87. Corner portion 75 comprises a side wall component of a right-angled flexible leg 81 and has protruding integrally from its exterior surface a ramp-like projection 85 which is laterally aligned with the ramp-like projection 83. The ramp-like projection 85 slopes outwardly of sleeve 26 from adjacent the proximal end 65 thereof and terminates in an abrupt shoulder 89 which is substantially coplanar with the shoulder 87. Slot 73 has an open end disposed in the proximal end 65 of sleeve 26 and has an opposing closed end adjacent the shoulders 87 and 89 of ramp-like projections 83 and 85, respectively. Thus, the slot 73 by virtue of separating the flexible leg 71 from the flexible leg 81 enhances the flexibility of the respective legs 71 and 81.

Spaced longitudinally from the plane of the respective shoulders 86–89 are block-like bosses 92 and 93 which protrude integrally outward from substantially central portions of the exterior surfaces of side walls 62 and 63, respectively. The bosses 92 and 93 are laterally aligned with the respective bosses 90, 91 and have sheer side surfaces, 98 and 99, respectively, which are substantially coplanar with the sheer side surfaces 96, 97 of the respective bosses 90 and 91. Consequently, the sheer side surfaces 98 and 99 are spaced from the plane of the respective shoulders 86–89 a predetermined linear distance substantially equal to the spacing of sheer side surfaces 96, 97 from the plane of the respective shoulders 86 and 87. Longitudinally aligned with the bosses 92 and 93 are respective open-ended slots 108 and 109 which extend longitudinally from respective open ends in the distal end 64 of sleeve 26 to respective closed ends disposed adjacent the bosses 92 and 93, respectively. The slot 108 is disposed between a longitudinally extending portion 106 of wall 62, which is adjacent wall 60 and comprises the other side wall component of right-angled flexible post 102, and a relatively fixed portion 110 of wall 62. Similarly, the slot 109 extends between a longitudinally extending portion 107 of wall 62, which is adjacent wall 60 and comprises the other side wall component of right-angled flexible post 103, and a relatively fixed wall portion 111 of wall 63. Thus, the slots 108 and 109 by virtue of separating the respective wall portions 106 and 107 from the respective laterally aligned wall portions 110 and 111 enhance the flexibility of the posts 102 and 103, respectively.

Figure 4:
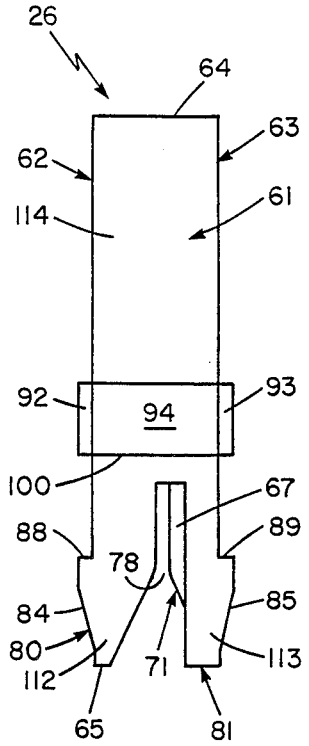
FIG. 4 is an elevational view of a side wall of the dielectric sleeve disposed in opposing relationship with respect to the fully slotted side wall shown in FIG. 2.

As shown in FIGS. 4, 5 and 6, the integral defining wall portions of sleeve 26 include a partly rigidized side wall 61 which is disposed substantially orthogonal to the partly slotted, side walls 62 and 63, respectively, and disposed in spaced opposing relationship with the fully slotted, open side wall 60. In the support-engaging end portion of sleeve 26, the flexible leg 80 has a side wall component comprising a wedge-shaped portion 112 of wall 61 which is disposed adjacent the side wall 62. The wedge-shaped portion 112 has an outer edge portion including a side surface of the integral ramp-like projection 84 which slopes outwardly of sleeve 26 from adjacent the proximal end 65 thereof and terminates in the abrupt shoulder 88. Also, the flexible leg 81 has a side wall component comprising a truncated wedge-shaped portion 113 of wall 61 which is disposed adjacent the side wall 63. The truncated wedge-shaped portion 113 has an outer edge portion including a side surface of the integral ramp-like projection 85 which slopes outwardly of sleeve 26 from adjacent the proximal end 65 thereof and terminates in the abrupt shoulder 89.

Spaced longitudinally from the plane of the respective shoulders 86–89 is a bar-like boss 94 which protrudes integrally outward from an exterior surface portion of wall 61 extending transversely the entire width thereof. The bar-like boss 94 is laterally aligned with the respective block-like bosses 90–93 and has adjacent the shoulders 88, 89 a sheer side surface 100 which is substantially coplanar with the other sheer side surfaces 96–99 of the bosses 90–93, respectively. Consequently, the sheer side surface 100 of bar-like boss 94 is spaced from the plane of the respective shoulders 86–89 a predetermined linear distance which is substantially equal to the predetermined linear distance of the respective sheer side surfaces 96–99 from the plane of the shoulders 86–89, respectively.

The sheer side surface 100 of bar-like boss 94 is disposed adjacent a closed end of a longitudinal slot 78 which extends through the thickness of wall 61. Slot 78 has an opposing open end portion terminating at the proximal end 65 of sleeve 26 and has an inverted funnel-like configuration which is disposed between the wedge-shaped portion 112 and the truncated wedge-shaped portion 113 of wall 61. The funnel-like, open end portion of slot 78 permits the flexible legs 80 and 81, respectively, to flex toward one another for enabling the support-engaging end portion of sleeve 26 to pass through the hole 28 in support panel 30 (FIG. 1). Thus, the slot 78 by virtue of separating the wedge-shaped portion 112 from the truncated wedge-shaped portion 113 of wall 61 and extending nearly to the bar-like boss 94 enhances the flexibility of the flexible legs 80 and 81, respectively. However, this flexibility is confined substantially to the support-engaging end portion of wall 61 by virtue of the rigidizing bar-like boss 94 being extended transversely of the wall 61 from the edge thereof adjacent side wall 62 to the edge thereof adjacent the side wall 63. The wall 61 has between the bar-like boss 94 and the distal end 64 of sleeve 26 a portion 114 which is completely closed and has opposing longitudinal edge portions integrally joined to the relatively fixed portions 110 and 111, respectively, of side walls 62 and 63.

As shown in FIGS. 2, 5 and 6, there is disposed within the sleeve 26 a transverse partition 116 which is integrally joined to the interior surfaces of the respective walls 60–63 of the sleeve. The partition 116 has a substantially planar surface 118 which is disposed adjacent the closed ends of the slots 108 and 109 in the side walls 62 and 63, respectively, and has an opposing, substantially planar surface 119 which is disposed adjacent the closed end of slot 78 in the wall 61. Extending through the thickness of partition 116 is a keyway slot 120 which has an open end portion 122 communicating with an aligned portion of longitudinal slot 24 in the wall 60. The keyway slot 120 extends from the open end portion 122 through a minimum width or restricted portion 124 to a larger closed end portion 126 which is centrally disposed within the sleeve 26. The material of the partition 116 on either side of the keyway slot 120 is sufficiently flexible to cooperate with the respective flexible posts 102 and 103 in pivoting laterally about the slots 108 and 109 in the side walls 62 and 63, respectively, to increase the width of the restricted portion 124 of keyway slot 120.

Figure 8:
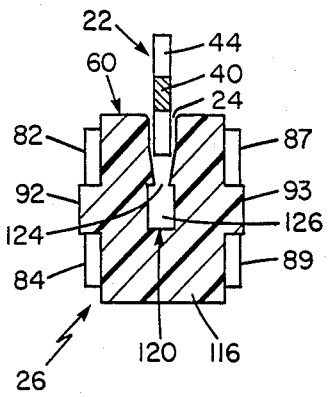
FIG. 8 is a transverse sectional view taken along the line 8—8 shown in FIG. 7 and looking in the direction of the arrows.
Figure 9:
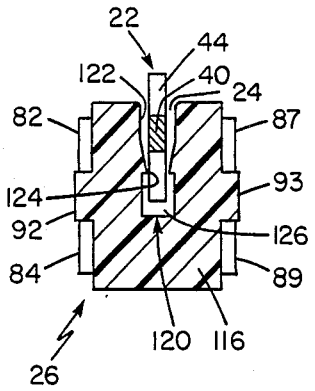
FIG. 9 is a transverse sectional view similar to FIG. 8 but showing the contact pressed laterally further into the sleeve.
Figure 10:
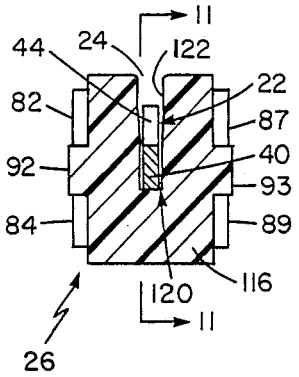
FIG. 10 is a transverse sectional view similar to FIG. 9 but showing the contact fully inserted into the sleeve.
Figure 7:
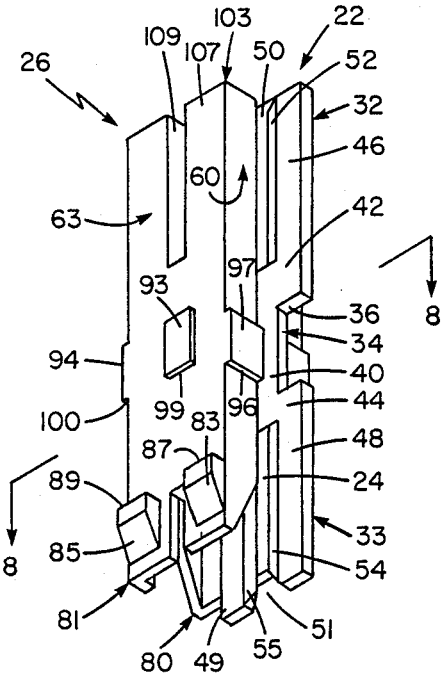
FIG. 7 is an isometric view of the contact and the sleeve shown in FIG. 1 partly assembled.

In assembly, as shown in FIGS. 7 and 8, the terminal contact 22 shown in FIG. 1 is inserted laterally into the longitudinal slot 24 in the open side 60 of sleeve 26. Accordingly, as shown in FIG. 9, the key 40 of contact 22 enters the open end portion 122 of keyway slot 120 and is brought into interference engagement with the restricted portion 124 of the keyway slot 120. A steady lateral pressure on the contact 22 forces the key 40 of contact 22 into the restricted portion 124 of keyway slot 120 which widens momentarily by virtue of the material of partition 116 on either side of the keyway slot 120 and the respective flexible posts 102 and 103 moving laterally about the respective slots 108 and 109 (FIGS. 5 and 6). As a result, the steady lateral pressure on the contact 22 causes the key 40 to snap into the closed end portion 126 of keyway slot 120 thereby removing the force which widened the restricted portion 124 of keyway slot 120. Consequently, the material of partition 116 on either of the keyway slot 120 and the respective flexible posts 102 and 103 pivot back in the reverse direction about the respective slots 108 and 109 thereby decreasing the width of the restricted portion 124 of keyway slot 120, as shown in FIG. 10.

Figure 11:
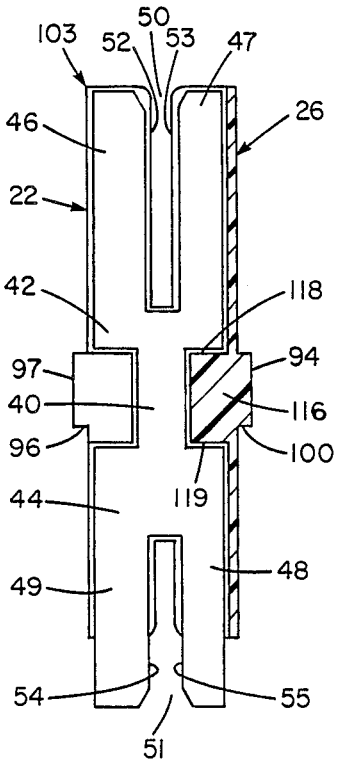
FIG. 11 is a longitudinal sectional view taken along the line 11—11 shown in FIG. 10 and looking in the direction of the arrows.

Thus, the key 40 cannot pass back through the reduced width of the restricted portion 124 of keyway slot 120 and thereby is locked securely within the closed end portion 126 of the keyway slot 120. As shown in FIG. 11, the length of the key 40 is preferably only slightly greater than the thickness of portion 116 whereby the wider portions 42 and 44 of contact 22 are disposed adjacent the surfaces 118 and 119, respectively, of the portion. Therefore, an axially directed insertion or withdrawal force exerted on the contact 22 will be resisted by either the wider portion 42 of contact 22 bearing against the adjacent surface 118 of partition 116 or the wider portion 44 of contact 22 bearing against the adjacent surface 119 of partition 116.

Figure 12:
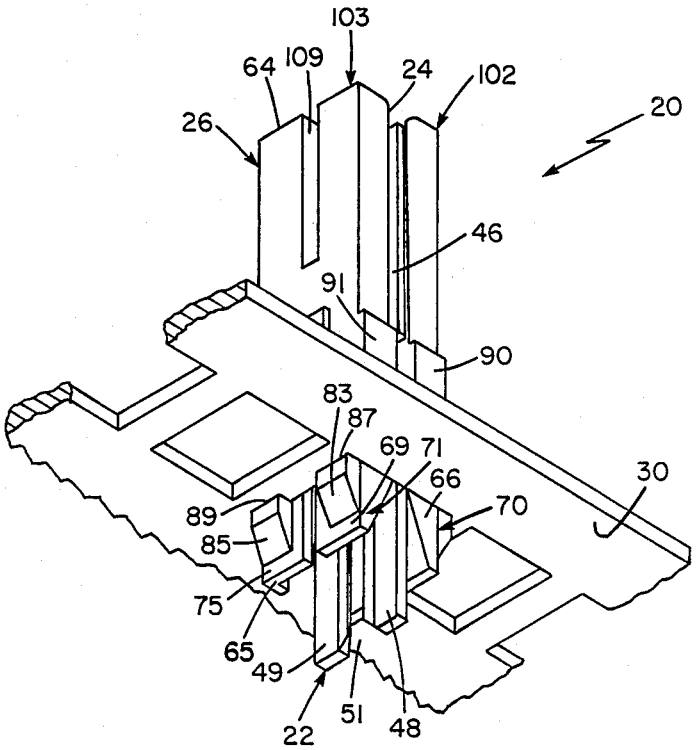
FIG. 12 is an isometric view of the assembled contact and outer sleeve shown in FIG. 11 but installed in the support plate shown in FIG. 1.

As shown in FIG. 12, the dielectric sleeve 26 with the contact 22 assembled therein, as described, may be installed in the support panel 30 shown in FIG. 1 by inserting the proximal end 65 of sleeve 26 into the hole 28. Consequently, the respective ramp-like projections 82–85 have their outwardly sloping surfaces brought into interference engagement with adjacent portions of the support panel 30 defining the periphery of hole 28. A steady axial pressure on the distal end 64 of sleeve 26 causes the flexible legs 70 and 71 to flex inwardly toward one another as a result of the sloping surfaces of the respective ramp-like projections 82–85 rubbing against said adjacent portions of the support panel 30 defining the periphery of hole 28. When the abrupt shoulders 86–89 of the ramp-like projections 82–85, respectively, pass through the hole 28, the flexible legs 70, 71, 80 and 81 flex outwardly of sleeve 26 to return to their respective relaxed states. Consequently, the respective shoulders 86–89 are brought into abutting relationship with the far surface of panel 30 adjacent the hole 28, and the respective sheer side surfaces 96–100 of the bosses 90–94 are brought into abutting relationship with the near surface of panel 30 adjacent the hole 28. Thus, the sleeve 26 is enabled to resist axially directed insertion or withdrawal forces exerted on the contact 22 by either the sheer side surfaces 96–100, respectively, or the shoulders 86–89, respectively, bearing against the adjacent surface of support panel 30.

Also, it is important to note that when the supporting-engaging end portion is passing through the hole 28 in support panel 30 and the respective flexible legs 70, 71 and 80, 81 are flexing inwardly of sleeve 26, as described, the integral wall portions of sleeve 26 and the periphery of the closed end portion 126 of keyway slot 120 are being tightened about the enclosed portions of contact 22. Consequently, when the respective flexible legs 70, 71 and 80, 81 return to their relaxed states to lock the support-engaging end portion of sleeve 26 within the hole 28 in support panel 30, the portions of support panel 30 defining the periphery of hole 28 are disposed snugly about the respective walls 60–63 of sleeve 26 thereby holding the restricted portion 122 of keyway slot 120 and the longitudinal slot 24 in open side wall 60 to their respective minimum width dimensions. As a result, the sleeve 26 is enabled to resist laterally directed forces exerted on the contact 22, such as during wire-wrapping of an end portion thereof, for example, with greater assurance and reliability.

Thus, there has been disclosed herein an elongated electrical contact having opposing end portions integrally joined to one another through a blade-like midportion having an hourglass configuration including a key extended between relatively wider portions of the contact. The elongated contact is insertable laterally into a longitudinal slot in a defining wall portion of a dielectric sleeve having transversely disposed therein an integral partition which has extended through its thickness a keyway slot. The keyway slot has an open end portion communication with an aligned portion of the longitudinal slot and extends from the open end portion through a reduced width, restricted portion to a relatively larger, closed end portion which is centrally disposed with the sleeve. Accordingly, the key is forced through the restricted portion of the keyway slot by virtue of the partition material on either side of the keyway slot and wall defining portions of the sleeve on either side of the longitudinal slot pivoting laterally to widen the restricted portion momentarily. As a result, the key snaps into closed end portions of the keyway slot and the restricted portion thereof closes down to its minimum width thereby locking the key securely in the closed end portion of the keyway slot.

What is claimed is:

1. A terminal contact assembly comprising:

a dielectric sleeve of flexible material including a tubular wall having extended through a longitudinally coextensive portion thereof a longitudinal slot with a predetermined width and including an integral partition transversely disposed within said tubular wall, said partition having extended through its thickness a transverse slot with an open end disposed in communication with an aligned portion of said longitudinal slot and provided with a width substantially equal to said predetermined width, said transverse slot being extended from said open end through a restricted portion of said transverse slot to an opposing closed end portion thereof, said restricted portion having opposing walls that taper inwardly to a reduced width less than said predetermined width and said closed end portion having an increased width greater than said reduced width; and an elongated electrical contact having opposing end portions integrally joined to an interposed blade-like midportion of said contact having a thickness less than said predetermined width and being laterally insertable through said longitudinal slot, said midportion being longitudinally disposed within said tubular wall of said sleeve and including a neck portion having opposing ends integrally joined to respective first and second wider portions of said midportion, said neck portion having a thickness greater than said reduced width of said restricted portion and less than said increased width of closed end portion of said transverse slot wherein said electrical contact is laterally insertable into said longitudinal slot and said open end of said transverse slot of said partition and, when lateral inward pressure is manually exerted on said electrical contact, said tapered opposing walls are separated by interference engagement with said neck until said neck passes through said restricted portion into said closed end portion at which time said opposing walls snap back thereby securing said electrical contact in said closed end portion.

2. A terminal contact assembly as set forth in claim 1 wherein said first and second wider portions of said midportion are disposed adjacent respective opposing surfaces of said partition.

3. A terminal contact assembly as set forth in claim 2 wherein one of said opposing end portions of said contact protrudes longitudinally from said tubular wall of said sleeve.

4. A terminal contact assembly as set forth in claim 2 wherein one of said opposing end portions of said contact is recessed within said tubular wall of said sleeve.

5. A terminal contact assembly comprising:

a support panel having therein a hole extended through first and second opposing surfaces and an interposed thickness of said panel, said hole having a predetermined periphery;

an elongated blade-like electrical contact extended longitudinally through said hole in said support panel and disposed in spaced relationship with said periphery thereof, said electrical contact having a predetermined thickness; and a dielectric sleeve of flexible material disposed about said contact and extended longitudinally through said hole in said support plate, said sleeve including a tubular wall having extended through a longitudinal portion thereof a longitudinal slot and having an outer surface disposed in contiguous relationship with said periphery of said hole, said sleeve also including an integral partition transversely disposed within said tubular wall and having extended through its thickness a transverse slot with an open end communicating with said longitudinal slot, said transverse slot being extended from said open end to an opposing closed end portion of said transverse slot having said electrical contact extended longitudinally through it, said transverse slot having means disposed between said open end and said closed end portion of said transverse slot for retaining said contact in said closed end portion of said transverse slot, said retaining means comprising opposing walls of said transverse slot that are tapered inwardly to a region of restricted width less than said predetermined thickness of said electrical contact such that as said electrical contact is inserted laterally into said transverse slot, said partition opens about said transverse slot as said blade-like electrical contact exerts an interference engagement force on said tapered walls until said electrical contact passes past said tapered walls and said tapered walls snap back, said tubular wall being provided with mounting means for securing said partition tightly about said contact and for securing said sleeve in said hole in said support panel.

6. A terminal contact assembly as et forth in claim 5 wherein said mounting means includes said tubular wall having a support engaging end portion comprised of a plurality of laterally spaced, flexible legs extended longitudinally of said tubular wall and disposed for longitudinal insertion into said hole in said support panel and for rubbing engagement with said periphery thereof.

7. A terminal contact assembly as set forth in claim 6 wherein said mounting means includes ramp means provided on the outer surfaces of said flexible legs for tightening said tubular wall and said partition about said neck portion of said midportion of the electrical contact, said ramp means being provided with sheer end surface means for lockingly engaging said second surface means of said support panel.

8. A terminal contact assembly as set forth in claim 7 wherein said mounting means includes boss means projecting integrally from outer surface portions of said tubular wall aligned with said ramp means for limiting said longitudinal insertion into said hole in said support panel, said boss means being provided with abrupt side surface means adjacent said sheer end surface means for abutting said first surface of said support panel and locking said support panel therebetween.

9. A method of assembling an elongated blade-like electrical contact into a dielectric sleeve of flexible material and comprising the step of:

inserting said electrical contact laterally into a longitudinal slot in an outer tubular wall of said dielectric sleeve;

inserting said electrical contact laterally into an open end of a transverse slot in an integral partition disposed transversely within said tubular wall; and forcing said electrical contact laterally through a portion of said transverse slot having inwardly tapered opposing walls tapering to a width less than the thickness of said electrical contact wherein said slot is opened by interference engagement of said electrical contact with said tapered walls, said electrical contact passing into a communicating closed end portion of said transverse slot.

* * * * *